United States Patent [19]

Myer

[11] Patent Number: 4,647,941

[45] Date of Patent: Mar. 3, 1987

[54] TELESCOPIC ANTENNA EXTENDED BY COAXIAL CABLE FEED

[75] Inventor: Robert E. Myer, Denville, N.J.

[73] Assignee: AT&T Bell Laboratories, Murray Hill, N.J.

[21] Appl. No.: 624,456

[22] Filed: Jun. 25, 1984

[51] Int. Cl.[4] ..... H01Q 1/10

[52] U.S. Cl. ..... 343/792; 343/903

[58] Field of Search ..... 343/877, 903, 790, 791, 343/792

[56] References Cited

U.S. PATENT DOCUMENTS

| | | | |
|---|---|---|---|
| 2,350,866 | 6/1944 | Barth | 343/903 |
| 2,538,885 | 1/1951 | Schumann | 343/900 |
| 3,158,865 | 11/1964 | McCorkle | 343/902 |
| 4,476,576 | 10/1984 | Wheeler et al. | 343/706 |

*Primary Examiner*—Eli Lieberman

*Attorney, Agent, or Firm*—Charles Scott Phelan

[57] ABSTRACT

A plural band telescopic antenna, including an added band much higher than the frequencies of the AM/FM band, is realized by making one telescopic section into a center-fed, high frequency antenna and using its coaxial cable feed line for also coupling mechanical extension and retraction forces to that section.

9 Claims, 4 Drawing Figures

TELESCOPIC ANTENNA EXTENDED BY COAXIAL CABLE FEED

FIELD OF THE INVENTION

This invention relates to antennas for radio equipment in vehicles, and it relates more particularly to such antennas which are adapted for retraction into an enclosure.

BACKGROUND OF THE INVENTION

It is often considered desirable to retract a radio antenna into the body of a vehicle such as a passenger automobile. There are numerous reasons, but in the case of such an automobile they include leaving the car lines clean when the radio is not in use and presenting fewer visible clues of the existence of or nature of radio equipment within the vehicle. The use of electrically powered mechanisms, coupled through a flexible rod, or cable element, makes it convenient to extend or retract telescopic antenna elements at will from inside the vehicle. U.S. Pat. No. 4,323,902 to J. L. Hussey et al. is an example of such a powered telescopic antenna.

A need for multiband operation has led to systems in which an additional band, besides e.g., the AM/FM commercial broadcast reception band, capability has been added as shown for example in the U.S. Pat. No. 4,325,069 to J. F. Hills. In this case, a telescopic antenna is modified by adding to the next-to-the-top segment a loading coil module which produces an effective length suitable for transmission and reception in the citizens' band while still providing acceptable reception in the mentioned commercial broadcast band.

SUMMARY OF THE INVENTION

A telescopic antenna is realized by making one telescopic section into a center-fed, high frequency antenna and using its coaxial cable feed line for also coupling mechanical extension and extraction forces to that section.

BRIEF DESCRIPTION OF THE DRAWING

A more complete understanding of the invention and its various features, objects, and advantages may be obtained from a consideration of the following Detailed Description in connection with the appended claims and the attached drawings in which:

DETAILED DESCRIPTION

Figure 1:
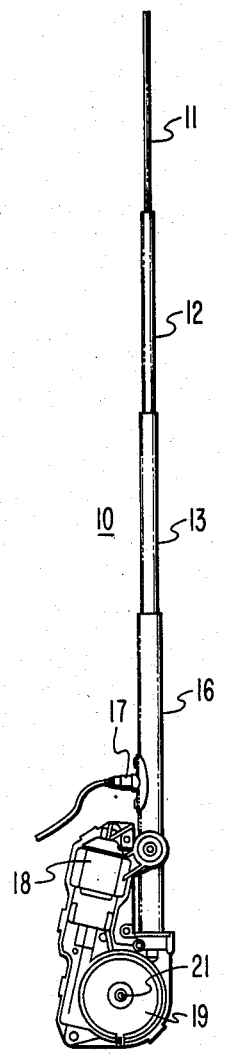
FIG. 1 is an extended, telescopic antenna including modifications in accordance with the invention.

In FIG. 1, a plural section telescopic antenna 10 includes three telescopically arranged sections 11–13 of the antenna mast which can be retracted into a base section 16 which is typically mounted beneath a fender, cowl, or the like, of a passenger automobile. A laterally extending tab is included on the top of section 16 for such mounting. A coaxial cable stud 17 is provided for coupling the illustrated sections electrically to a suitable AM/FM band radio receiver. An electric motor such as the 12-volt direct current motor 18, is controlled (by connections not shown) for selectably actuating a reel, or spool, mechanism in a housing 19 to extend or retract a coaxial cable 20 (in FIGS. 2–4). The cable extends through the various antenna sections 12, 13, and 16 and into the section 11 where it is secured in a manner which will be described for transferring mechanical forces for extending or retracting the antenna sections. A coaxial cable stud, or connector, 21 is mounted on the axis of rotation of the reeling assembly in housing 19 and connected within the reel to the cable 20. The reel assembly is advantageously provided with a circumferential gear rack which is cooperatively engaged with a worm gear driven by motor 18. Cable 20 replaces the flexible, nonconducting rod or cable usually found in powered telescopic antenna systems for coupling driving forces to the telescopable sections.

Figure 2:
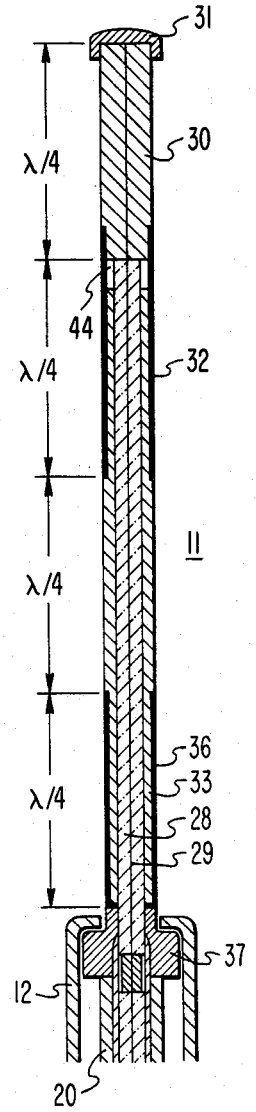
FIG. 2 is an enlarged, side, cross-sectional view of an upper section of the antenna of FIG. 1.

In FIG. 2, the antenna section 11 is shown in enlarged scale within the upper end of section 12. In this side view, the section elements are shown in cross section taken vertically through the center line of the antenna of FIG. 1 and looking in from the vantage of a viewer of FIG. 1. Section 11 is arranged to operate as a high frequency, center-fed, half-wave dipole antenna in, for example, the 850 megahertz cellular radio band; and it comprises four parts, each approximately one-quarter wavelength long at approximately the center of the high frequency band in which the antenna of this section is to operate.

Cable 20 is advantageously flexible, 50-ohm cable having an outer diameter somewhat smaller than the inside diameter of antenna section 12, and it is spliced near the top of that section to a rigid, smaller diameter, 50-ohm, coaxial rod 28. A center conductor 29 of the rod 28 extends through a cylindrical member 30 of dielectric material, such as a hard TEFLON rod, for lateral rigidity. A cap 31 of similar material is secured to the top of cylinder 30, and its outside diameter is large enough to act as a stop when it encounters section 12 during retraction of the sections. Both inner and outer conductors of rod 28 are advantageously made of copper clad steel to enhance antenna operation. In fact, the portion of conductor 29 in cylinder 30 is the upper half of a vertical, center-fed, half-wave, dipole antenna of the type described in, for example, "Antenna Engineering Handbook," edited by H. Jasik, McGraw-Hill Book Company, 1961, at pages 22–2 through 22–14. Cylinder 30 is bonded to the upper end of rod 28 and to an annular electrical connection between the upper tip of the outer conductor of rod 28 and a conductive sleeve, or skirt, 32 which encloses the quarter-wave length portion of rod 28 just below cylinder 30. Lateral rigidity at the bond is improved by extending the upper end of skirt 32 and bonding cylinder 30 therein to prevent articulation at the joint. The skirt 32 comprises the lower half of the dipole antenna and is fed at its upper end by the outer conductor of the rod 28. An interspace between skirt 32 and the outer conductor of rod 28 is advantageously filled partly with air and partly with an upper section of a cylinder 33 of dielectric material, such as hard Teflon, which encloses approximately three, quarter-wave, length portions of rod 28. The length of the portion of cylinder 33 which is inside skirt 32 is selected to determine the length of an air pocket 44 above the cylinder 33. A length for that air pocket is selected to make the electrical length of the inside longitudinal path of the skirt longer than the outside path thereof to compensate for antenna and effect. Skirt 32 is preferably made of copper clad steel, again to enhance its operation as part of an antenna. A further improvement can be realized by silver plating skirt 32, its connection to rod 28, and both conductors of rod 28.

Next below skirt 32 is another quarter-wave length of cylinder 33. This length has an enlarged outside diameter equal to the outside diameter of skirt 32. This enlarged diameter section of cylinder 33 helps to provide electrical isolation between the dipole antenna and the antenna section 12. Further isolation is provided by a rigid, coaxial, copper clad, steel choke 36 enclosing the next lower, quarter-wave, length end of rod 28. Choke 36 has an outside diameter equal to that of the portion of skirt 32 and of cylinder 33 between them. This arrangement of cylinder 33 causes a high impedance point to be present both at the lower end of skirt 32 and at the upper end of choke 36 thereby enhancing the appearance of choke 36 as a ground plane insofar as the half-wave dipole above is concerned. By having the high frequency section 11 of the antenna assembly at the top, and RF isolated by the choke 36, the transmission and reception functions are improved over what they are when the high frequency antenna is mounted using the body of the car as a ground plane. This is because variations in the car body contours have less effect on antenna operation.

The lower end of choke 36 is turned radially inward to provide electrical contact to the outer conductor of rod 28. The upper tip of antenna section 12 is also turned radially inward to make sliding mechanical contact with the outside surface of a nonconducting stop member 37. Although there is no direct electrical connection between section 12 and the outer conductor of rod 28, it has been found that there is no substantial loss in AM/FM band reception as compared to prior AM/FM band antennas with a conventional upper section. This stop is bonded to the lower tip of choke 36 and to a portion of rod 28 extending downwardly out of the lower end of choke 36. Member 37 has an outwardly extending shoulder which engages the inwardly extending portion of the section 12 tip to mechanically stop the extension of the overall antenna when it attains the illustrated relative positions of sections 11 and 12. Otherwise, the outside diameter of stop 37 is somewhat smaller than that of the inside of section 12 so that the two can slide easily relative to one another during extension and retraction. This arrangement provides sufficient mechanical rigidity to inhibit articulation at the joint between sections 11 and 12.

Below stop member 37 the inner conductor of flexible coaxial cable 20 is connected to the inner conductor of coaxial rod 28. A shrink-fit sleeve of dielectric material encloses that connection. Outer conductors of cable 20 and rod 28 are also connected at that point, and it has been found to be useful in the case of a solder connection to allow some solder to run downward into the weave of the outer conductor of cable 20 to lend additional rigidity to the mechanical connection between cable 20 and rod 28 for helping the coaxial inner and outer conductors transfer extension and retraction forces to section 11. Outer dielectric coating around the outer conductor of cable 20 has an outer diameter which is sufficiently smaller than the inside diameter of antenna section 12 so that cable 20 slides easily within section 12 in essentially the same fashion as the nonconducting flexible cables or rods in known retractable powered antennas.

Figure 3:
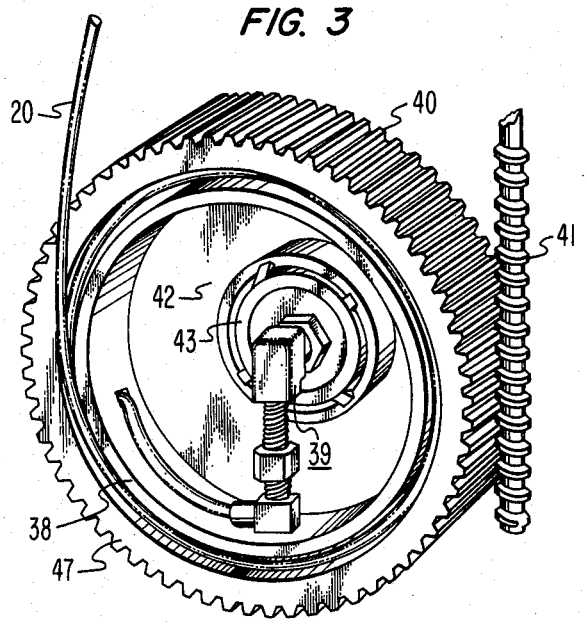
FIG. 3 illustrates a perspective view of a reel, or spool, drive portion of the antenna of FIG. 1.

In FIG. 3 is shown the inside of housing 19 to depict the aforementioned reeling assembly. Such mechanisms are known in the art so only enough is shown here to indicate the manner of providing electrical connection to cable 20 as it is used for extending and retracting antenna sections. Cable 20 is wrapped around a take-up spool 38 when the spool is turned to retract the antenna. The end of cable 20 is passed through a hole in the face of the spool to the interior where it is coupled through various coaxial fittings. A coaxial rotary joint 39 is one of those fittings and is mounted with its axis of rotation collinear with the axis of rotation of the spool 38. Such fittings are of a type well known in the art. The stationary part of the rotary joint 39 comprises the coupling 21 (not shown in FIG. 3) Spool 38 has secured to the far side thereof, and on the same axis of rotation, a cylindrical outside rack 40 which engages a worm gear 41 for driving the spool 38. A web 42 fixes the axial position of one of the relatively rotatable parts of rotary joint 39 within spool 38 and its rack 40.

Figure 4:
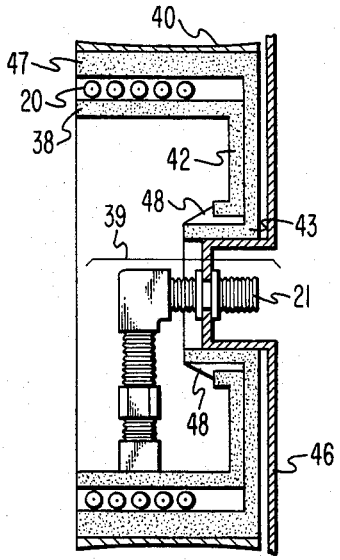
FIG. 4 is a side view, partly in section, of the reel drive portion of FIG. 3.

FIG. 4 is a side view, partly in section at lines 4,4 in FIG. 3 of the reeling assembly. In FIG. 4, the spool 38 is nested inside an outer spool 47 and held there by snaps 48 on a hub 43. Spool 47 enclosed closely the turns of cable 20 on spool 38 so that the turns are held to approximately the illustrated diameter during antenna extension. This makes it possible to translate the rotational driving force of the reeling assembly to a longitudinal pushing force on the cable 20 to extend the antenna.

Spools 38 and 47 are, through hub 43, rotatably mounted in a cylindrical bearing surface in a portion 46 of the housing 19. In this view only the nested spools, hub 43, the turns of cable 20, and the housing portion 46 are shown in section to illustrate the relative positions of the parts and to shown more clearly the coupling 21, which is the other of the relatively movable parts of the rotary joint 39.

Although the present invention has been described in connection with a particular embodiment thereof, it is to be understood that other embodiments, modifications, and applications thereof which will be obvious to those skilled in the art are included within the spirit and scope of the invention.

What is claimed is:

1. A telescopic antenna comprising at least upper and lower telescopic rod sections, said upper section having a total electically effective length of about one wavelength at the center of a predetermined band of frequencies and comprising a three-quarter wavelength coaxial conductor rod including outer and inner conductors, means for extending said inner conductor of said rod one-quarter wavelength beyond an end of said rod to form a first half of a half-wave, dipole antenna in said predetermined band, an electrically conductive sleeve enclosing a first quarter-wave portion of said rod at said end thereof and electrically connected to said outer conductor to form a second half of said dipole antenna, a length of dielectric material enclosing approximately a second quarter-wave length of said rod adjacent to said first length, and an electrically conductive, quarter-wave length of conductive material enclosing a third quarter-wave length of said rod adjacent to said dielectric material to form a coaxial isolating choke, and means, including a coaxial cable extending through the interior of said sections, for coupling mechanical extension and retraction forces to said sections, said coupling means also serving as electrical line feed for said dipole antenna.

2. The telescopic antenna in accordance with claim 1 in which there are provided means for electrically coupling said lower section to said rod for electrically including at least a part of said dipole antenna with said lower section in an antenna for a second band of frequencies much lower than said predetermined band.

3. The telescopic antenna in accordance with claim 1 in which said dielectric material includes portions extending into said sleeve and said choke to fix their coaxial relation to said rod.

4. The telescopic antenna in accordance with claim 3 in which said dielectric portion in said sleeve extends only partly to said end of said rod, the length of said material portion being selected to compensate for antenna end effects on said sleeve.

5. A telescopic antenna comprising a plurality of telescopic rod sections including at least upper and lower telescopic rod sections, means, in at least a part of at least said upper one of said sections but in less than all of said sections, for comprising an antenna for a predetermined band of frequencies, said at least lower section is not a part of said predetermined band antenna and comprises an antenna in a second band of frequencies much lower in frequency than said predetermined band, and means, including a coaxial cable extending through the interior of said plurality of sections, for coupling mechanical extension and retraction forces to said sections, said coupling means also serving as electrical line feed for said predetermined band antenna.

6. The telescopic antenna in accordance with claim 5 in which said plurality of sections comprise said second band antenna.

7. The telescopic antenna in accordance with claim 5 which includes in addition means for providing, in said predetermined band, electrical isolation between said predetermined band antenna and any lower portion of said telescopic antenna.

8. The telescopic antenna in accordance with claim 5 in which said antenna for said predetermined band is a center-fed dipole antenna.

9. The telescopic antenna in accordance with claim 8 in which said coupling means comprises in said coaxial cable a rigid coaxial conductor rod having an inner conductor and an outer conductor electrically connected to feed said dipole antenna, a relatively flexible cable portion having spaced coaxial inner and outer conductors electrically connected to said inner and outer conductors of said rod, and means for mechanically coupling said cable portion to said rod for transmitting to said rod said extension and retraction forces.

* * * * *